United States Patent [19]

Carter

[11] 4,060,229

[45] Nov. 29, 1977

[54] ROTARY GLUE PICKER

[75] Inventor: Sidney T. Carter, Shrewsbury, Mass.

[73] Assignee: A-T-O Inc., Cleveland, Ohio

[21] Appl. No.: 671,172

[22] Filed: Mar. 29, 1976

[51] Int. Cl.[2] ..... B65C 9/16; B65H 3/20

[52] U.S. Cl. ..... 271/33; 118/231; 118/236; 156/568; 156/571; 156/DIG. 32

[58] Field of Search ..... 156/571, 568, 567, 521, 156/519, DIG. 29, DIG. 30, DIG. 32; 271/33, 93, 95, 114, 115, 270, 276; 118/231, 236

[56] References Cited

U.S. PATENT DOCUMENTS

| | | | |
|---|---|---|---|
| 3,546,047 | 12/1970 | Dullinger | 156/568 X |
| 3,736,213 | 5/1973 | Jorss et al. | 156/570 |
| 3,767,515 | 10/1973 | Eder | 156/568 |
| 3,837,974 | 9/1974 | Carter | 156/568 X |
| 3,919,040 | 11/1975 | Zodrow | 156/571 |
| 3,923,589 | 12/1975 | Tavernier | 156/568 |
| 3,928,120 | 12/1975 | Zodrow | 156/571 X |

*Primary Examiner*—Charles E. Van Horn
*Assistant Examiner*—M. G. Wityshyn
*Attorney, Agent, or Firm*—Dike, Bronstein, Roberts, Cushman & Pfund

[57] ABSTRACT

Apparatus wherein a picker provided with an arcuate surface is supported for movement in a circular path at a radial distance from a predetermined center of rotation relative to a glue applying roll, a stack of labels and a transfer turret arranged about said predetermined center characterized in that there is means for effecting movement of the picker along said path and effecting rotation of the picker about the center of its arcuate surface such that said arcuate surface will have exclusively rolling tangential engagement with the surface of the glue applying roll, the surface of the label and the surface of the turret comprising, a fixed sun gear at said predetermined center having portions of different radius of curvature by means of which the rotation of the picker may be accelerated or decelerated, a planetary gear at the center of rotation of the arcuate surface of the picker for effecting its rotation, an idler gear in mesh with the planetary gear movable around the fixed gear in consonance with the planetary gear, means supporting the idler gear for movement relative to the sum and planetary gears as the radius of curvature of the sun gear varies from place to place and a cam for maintaining the idler gear in mesh with the sun and planetary gears as the planetary gear travels around the sun gear.

7 Claims, 10 Drawing Figures

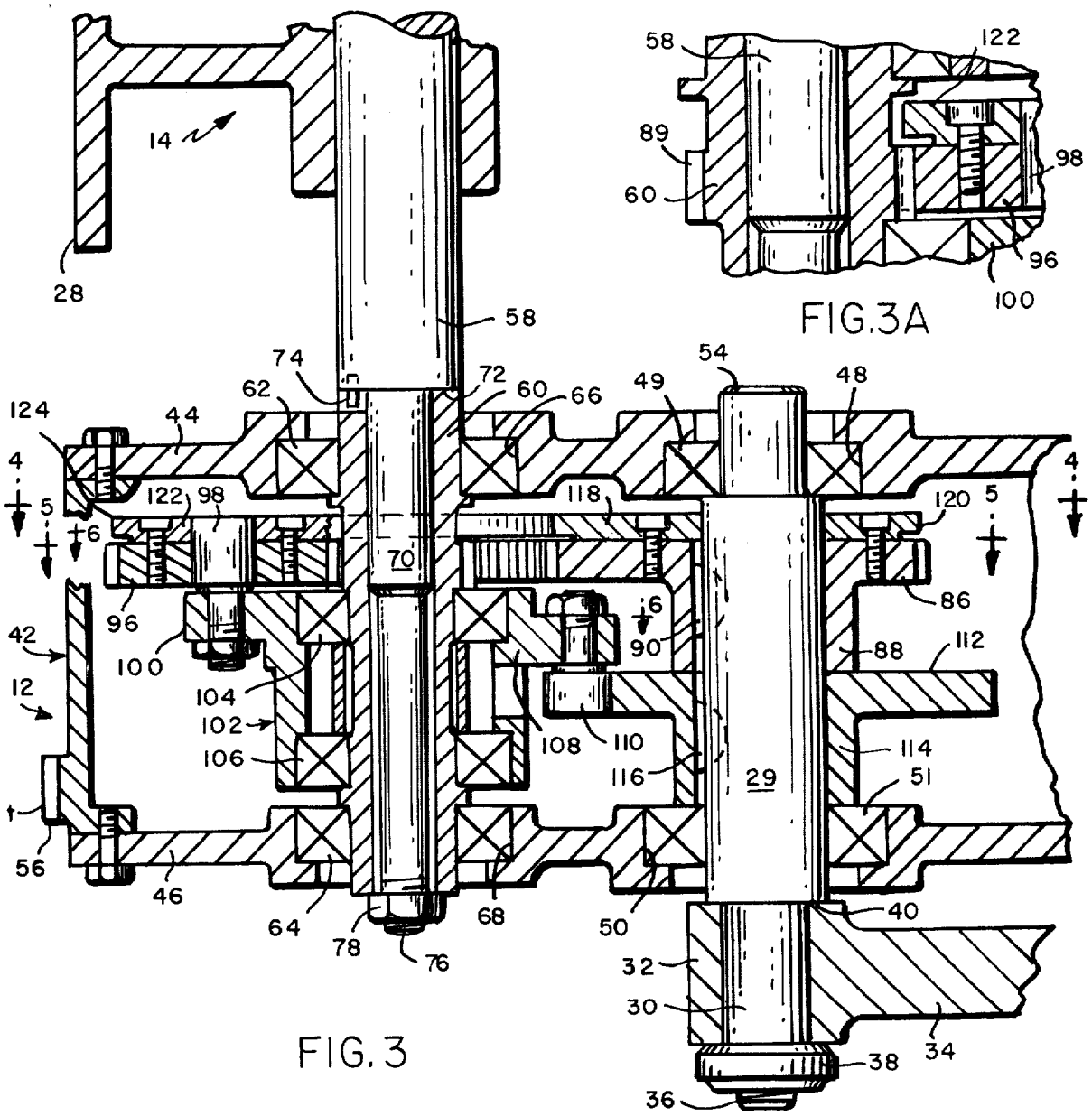
FIG. 3
FIG. 3A
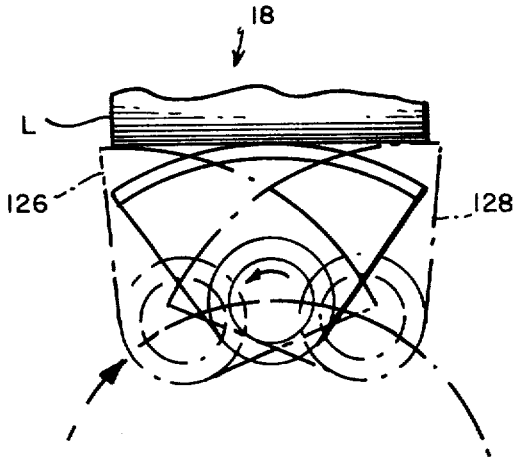
FIG. 8
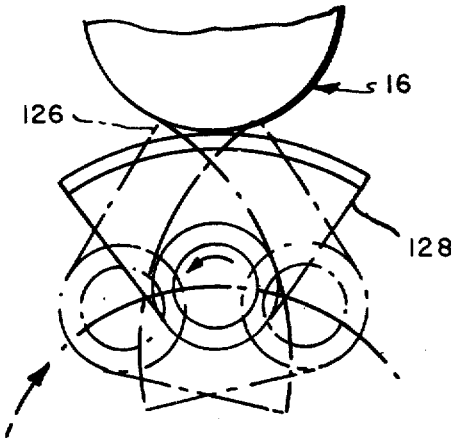
FIG. 7

ROTARY GLUE PICKER

BACKGROUND OF INVENTION

Apparatus wherein a picker is provided with an arcuate surface arranged to travel in a circle about a predetermined center relative to a glue roll, a stack of labels and a transfer turret and wherein there is mechanism for effecting acceleration and deceleration of the picker during its circular movement at the several stations in an effort to obtain rolling engagement with the surface of the glue roll, label and transfer roll is known. The acceleration and deceleration is achieved according to one known apparatus by employing planetary gears and a complicated compensating gearing which is only partially effective in that it provides for true rolling contact only at the place of tangential contact of the cylindrical and flat surfaces with the path of travel of the picker. Furthermore, such gearing is expensive, difficult to maintain and inherently disadvantageous in that it creates excessive centrifugal forces which tend to defeat its purpose. U.S. Pat. No. 3,928,120 which relates to the same kind of apparatus was intended to provide an improvement over the known apparatus by employing a coarse thread in place of the usual compensating gearing. The apparatus as herein illustrated is designed to obtain true rolling tangential engagement of the arcuate surface of the picker at each station throughout its arcuate width without the need for the aforesaid adjustable compensating gearing and/or coarse thread with an arrangement of sun, planetary and idler gears which is of simple design and the operation of which is not adversely effected by high speed operation.

SUMMARY OF INVENTION

Apparatus for moving a part having an arcuate surface of predetermined radius of curvature around a fixed center relative to a plurality of stations arranged about said centers where there are instrumentalities having surfaces with which the arcuate surface of the part is to have tangential contact as it travels by and for rotation about the center of its arcuate surface at each station to cause the arcuate surface to have solely rolling tangential engagement with the surface of the instrumentality at each station. The part is a picker and at the stations there are a glue applying roll of predetermined diameter, a label holder for holding the flat surface of a label for application of glue thereto and a transfer turret of predetermined diameter to which the glue coated label is transferred. The picker is supported at a predetermined radial distance from a fixed center for rotation about said center and is provided at its center of rotation with a gear which travels around a circle with the picker. At the fixed center there is a sun gear of variable radius of curvature and there is an idler supported with and in engagement with the planetary gear for movement in consonance therewith about the sun gear which is movable relative to the axis of the sun gear and means for moving it relative to the sun gear to maintain it in mesh therewith throughout said circular movement. The sun gear is designed so that the portions of different radius of curvature coincide with the different stations to increase or decrease the accleration of the rate of rotation of the picker at each station according to the surface at that station and, in effect, to insure solely rolling tangential engagement.

The invention will now be described with reference to the accompanying drawings, wherein:

FIG. 3 is a fragmentary vertical section of the apparatus taken on the center line of rotation shown in FIG. 1, showing the lower part of one picker;

FIG. 3A is an enlarged fragmentary section showing one of the bearing sleeves at the place of meshing of the idler gear with the picker gear.

FIG. 7 shows the various positions of the picker while in rolling engagement with the glue roll;

FIG. 8 shows the varying positions of the picker while in rolling engagement with the endmost label in a stack of labels.

Figure 1:
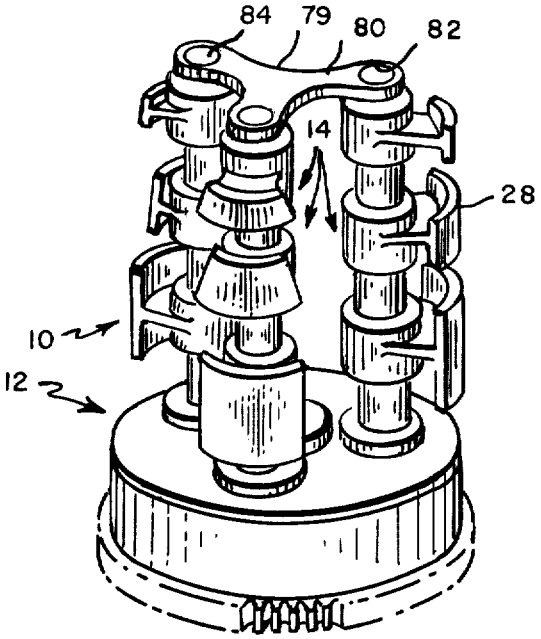
FIG. 1 is a perspective view of the apparatus showing three picker assemblies arranged around a common center, each of which is provided with three vertically spaced picking elements.
Figure 2:
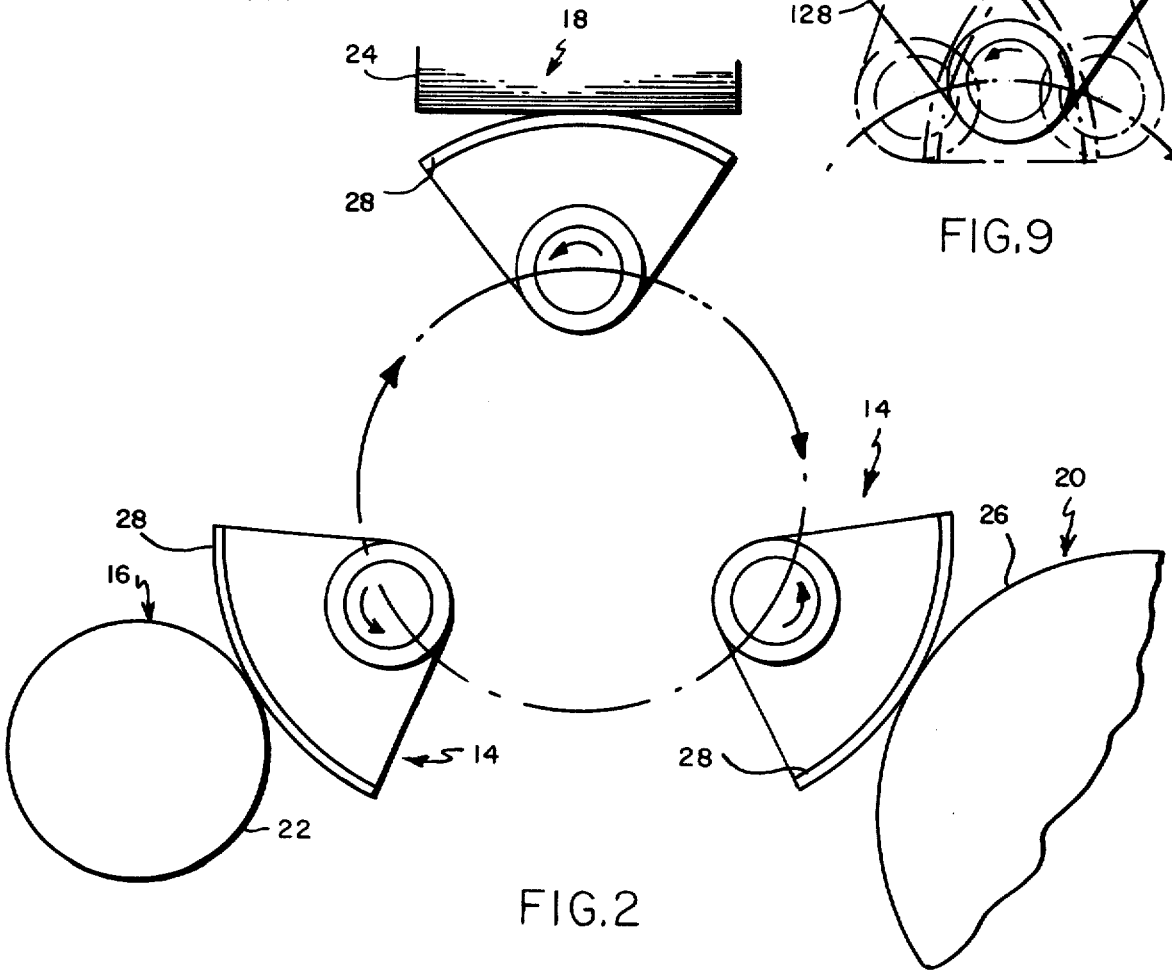
FIG. 2 is a plan view to a larger scale showing the path of rotation of the pickers relative to a glue applying roll, a stack of labels and a transfer turret.
Figure 4:
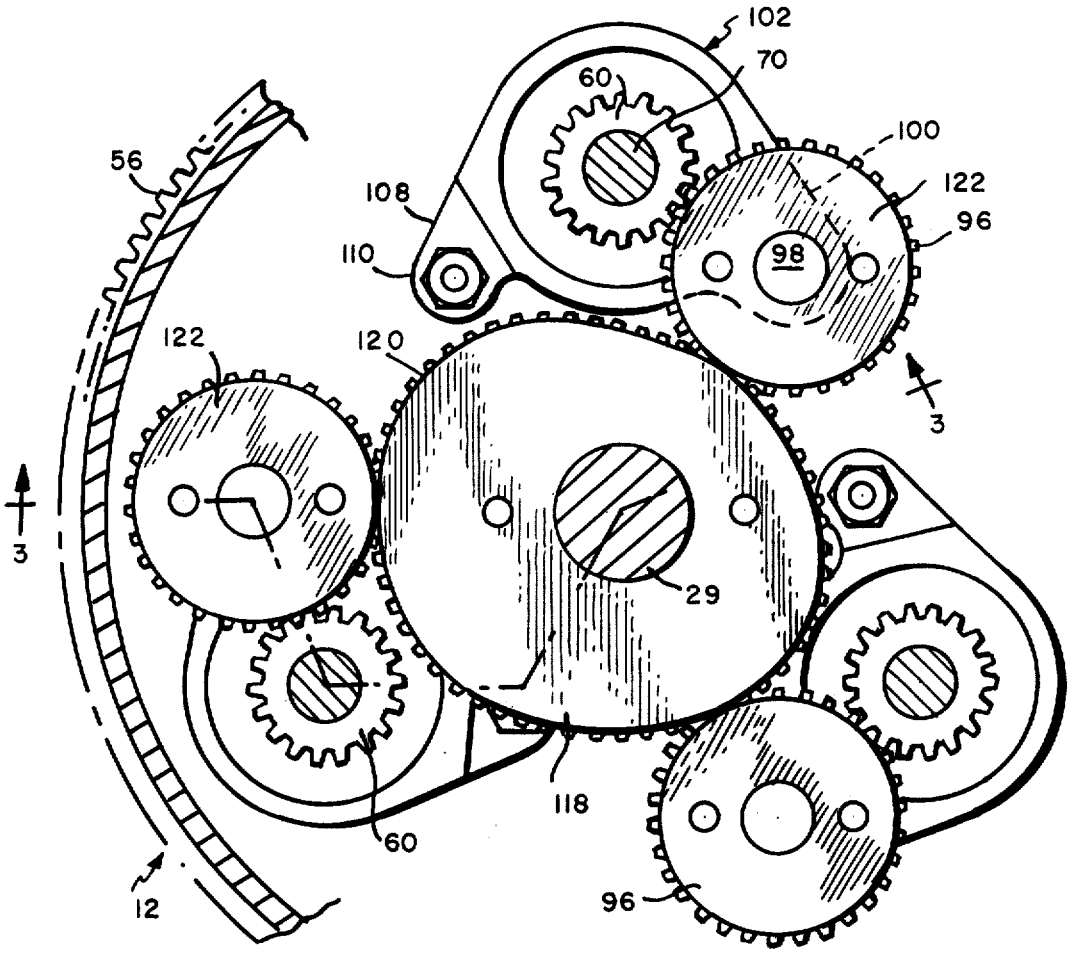
FIG. 4 is a fragmentary horizontal section taken on the line 4—4 of FIG. 3.

Referring to the drawings, FIGS. 1 and 2, there is shown a picker apparatus 10 comprising a support 12 on which there are mounted three pickers 14 at equally spaced intervals about the center of the support 12 and at equal radial distances therefrom for rotation with the support in a circular path relative to a glue carrying roll 16, a stack of labels 18 and a transfer turret 20. The glue carrying roll 16 rotates about a vertical axis which is parallel to the axis of rotation of the support 12 and has a perpendicular peripheral glue carrying surface 22. The labels in the stack of labels are supported with their surfaces in a vertical plane parallel to the axis of rotation of the support 12 in a label box or magazine 24. The transfer turret 20 is a cylindrical structure rotatable about a vertical axis parallel to the axis of the support 12 and has a perpendicular peripheral surface 26. Each picker 14 has three vertically spaced picking elements which have arcuate surfaces 28 corresponding substantially in circumferential length to the labels to be applied.

The support 12 is mounted for rotation about its center on a perpendicular shaft 29, FIG. 3, the lower end of which is provided with a portion 30 of reduced cross section stepped into a hub 32 at the distal end of a horiztonal supporting bracket 34. The reduced end 30 has a threaded section 36 and a nut 38 screwed onto the threaded extension against the lower side of the hub 32 provided in conjunction with a shoulder 40 at the junction of the reduced portion 30 with the shaft means for clamping the shaft rigidly to the bracket 34.

The support 12 comprises a cylindrical structure 42 to the upper and lower ends of which are bolted bearing supporting plates 44 and 46. Centrally of the plates 44 and 46 are bearing recesses 48 and 50 within which there are situated anti-friction bearings 49 and 51 which are of a size to receive the lower end of the shaft 29 and a reduced section 54 at the upper end of the shaft whereby the support 12 is free to rotate about the shaft 29. At the lower part of the support 12 on its outer peripheral surface there are teeth *t* which collectively form a ring gear 56 by means of which the support 12 may be driven in rotation about the fixed shaft 29, for example, by a pinion meshing with the ring gear.

Each of the pickers 14, FIG. 3, is mounted on a vertically supported shaft 58 which is supported for rotation about its vertical axis in a bearing sleeve 60, the sleeve itself being rotatably supported in the support 12 by anti-friction bearings 62 and 64 situated in bearing openings 66 and 68 in the bearing plates. The shaft 58 has a reduced extension 70 which provides at its junction with the shaft 58 a shoulder 72 which rests on the upper end of the sleeve 60 and is keyed to the sleeve by a key 74. The extension 70 is threaded at its lower end 76 and a nut 78 engaged with the lower end of the sleeve clamps the shaft to the sleeve. The upper end of the shafts 58 of which there are three are connected by a spider plate 79 provided with radially extending arms 80 containing bearing openings 82 for rotatably receiving reduced portions 84 at the upper ends of the shafts 58.

Figure 5:
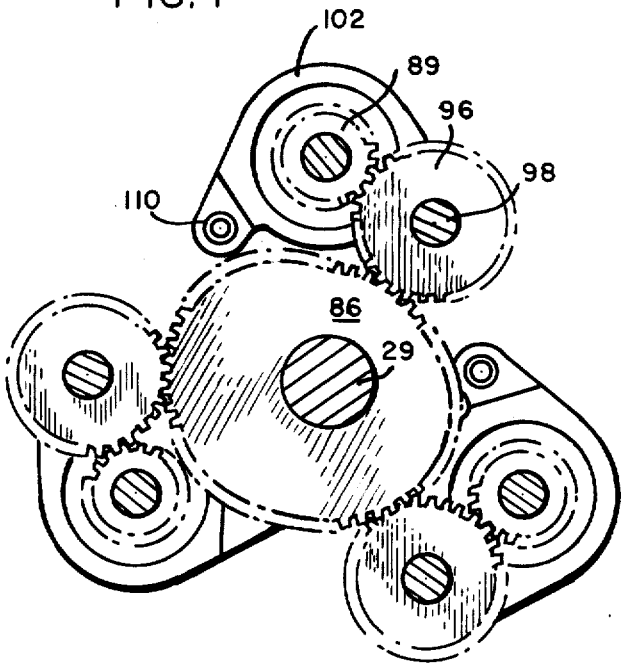
FIG. 5 is a fragmentary horizontal section taken on the line 5—5 of FIG. 3.

A large gear 86, FIGS. 3 and 5, is mounted at the center of the support 12 on the shaft 29 and is fixed thereto by means of an integral hub 88 and the key 90. The gear 86 is in the nature of a sun gear and as shown in FIG. 5 is of varying radius. A small gear 89 is fixed integral with the sleeve 60.

The pickers are moved in a circular path about the axis of the shaft 29 by rotation of the support 12 and while they are traveling around the shaft 29 the pickers are rotated about the vertical axes of their shafts 58 by a connecting gear 96, FIG. 3A, in the form of an idler rotatably mounted on a stub shaft 98 fixed to one arm 100 of a bracket assembly 102. The bracket assembly 102 is in turn rotatably mounted on the sleeve 60 being rotatably supported thereon by bearing assemblies 104 and 106 surrounding the sleeve. The bracket assembly has a second arm 108 symmetrically located with respect to the arm 100 on which there is rotatably mounted a follower 110. The idler gear 96 is thus adapted to be rotated about the axis of the shaft 58 relative to the sun gear 86 and to rotate about its own axis in mesh with the gear 89. The idler gear 96 is maintained in mesh with the gear 86 as the radius of the latter varies by a cam 112, FIG. 3, mounted on the shaft 29 and fixed thereto by means of an integrally formed hub 114 and key 116. As the picker shaft is carried around the shaft 29 the follower 110 travels around the periphery of the cam 112 and thus turns the bracket assembly 102 about the axis of the shaft 58 as the radius of the sun gear 86 changes to maintain the idler gear 96 in mesh with both the sun and planetary gears and thus to vary the rotation of the shaft 58 either to accelerate or decelerate its rotation.

In order to prevent the sun gear and idler gear from jamming there is mounted on the upper face of the sun gear 86 a cam plate 118 which has a peripheral edge 120 and on the idler gear 96 a cam plate 122 having a peripheral edge 124. The peripheral edge of the cam plate 118 is contoured to correspond to the peripheral edge of the cam plate 112 and the cam plate 124 is circular. Both plates extend radially beyond the root circle of the teeth so as to prevent the meshing teeth from inter-engagement to an extent to jam.

The purpose of the gearing as described is to provide for rolling contact of the arcuate surface of the picker elements with the surface of the glue roll, the labels and the transfer turret. Since the arcuate surfaces of the glue roll and transfer cylinder are of different radius of curvature it is necessary to change the rate of rotation of the pickers while in contact with these surfaces and since the transfer turret is the larger of the two the rate of rotation has to be increased. While in contact with the flat surface of the label the picker must be moved at still another rate and this happens to be between that of the glue roll and the transfer turret. The ratio of rotation of the pickers to the glue roll is approximately 3.80 to 1.00 and to the transfer turret approximately 3.30 to 1.00. The rate of rotation relative to the label is approximately 2.31 to 1.00. These ratios would, of course, change with changes in the dimensions of the picker, glue roll and transfer turret.

Figure 6:
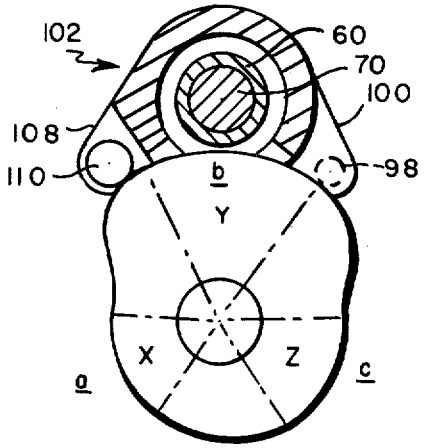
FIG. 6 is a fragmentary horizontal section taken on the line 6—6 of FIG. 3.
Figure 9:
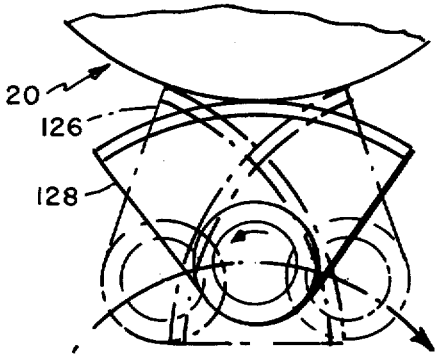
FIG. 9 shows the various positions of the picker while in rolling engagement with the transfer turret.

Referring to FIGS. 7, 8 and 9 the various positions of the picker in relation to the surfaces of the glue roll, labels and transfer turret are illustrated and it is to be observed that the pickers travel in a clockwise direction about the axis of the shaft 29 relative to the glue roll, labels and transfer turret an while so traveling the pickers themselves rotate in a counterclockwise direction about the axis of the shaft 58. As a picker approaches the glue roll, FIG. 7, the trailing edge 126 first comes into contact with the surface of the glue roll. As the picker travels further in a clockwise direction to the point where its center of rotation lies on the center line thru the center of the glue roll and the axis of the shaft 29, the picking surface has traveled half of its peripheral length so that its mid-point is tangential to the glue roll at a point on the center line drawn thru the axis of rotation of the glue roll and axis of rotation of the shaft 29 and finally, as the center of rotation of the picker travels beyond the aforesaid center line the leading edge 128 leaves the surface of the glue roll. Correspondingly, as shown in FIG. 8, the trailing edge 126 of the picker first engages the endmost label and the leading edge 128 is the last to engage the label. The picking surface midway between its ends is tangent to the label at a point on a line perpendicular to the label surface midway between its ends and which passes thru the axis of rotation of the picker shaft 58 and the shaft 29. The same is also true of the engagement and disengagement of the picker with the transfer as shown in FIG. 9. As stated before, in order that this rotation which is tangent to the respective surfaces, be solely rolling engagement as contrasted to scuffing, that is, relative sliding movement between the surfaces, it is necessary to vary the rate of rotation of the picker and this is achieved by means of the gear 86 and correspondingly contoured cam 112. The several sections which provide for the changes in rotational speed at the glue roll, label magazine and transfer turret are shown in FIG. 6, these sections being indicated by the acrs *a*, *b* and *c* bounding the pie-shaped sections X, Y and Z.

While each of the pickers is shown as provided with three picking elements 28 of arcuate surface it is within the scope of the invention to change the number of picking elements to less than or more than three and also change the number of pickers from three to two or one. It is to be noted that there is a label holder for each picker element heightwise of the picker.

In the operation of the apparatus the picking elements of a picker first have rolling engagement with the adhesive on the surface of the adhesive roll, and during such rolling engagement of the surfaces of the picker elements with the glue applying roll the entire arcuate surfaces become coated with a uniformly thick layer of adhesive. When the coated picker elements reach the label magazine or box the rolling engagement of the arcuate picker surfaces with the labels concurrently apply adhesive to the exposed surface of the endmost labels at the left end as shown in FIG. 2 and as they travel by progressively apply a uniformly thick layer of adhesive from the one end to the other without scuffing or rubbing the adhesive and progressively pick the labels from the stacks. Having removed the labels from the stacks the picker carries them around to the transfer turret 20 and progressively rolls them onto the surface of the transfer turret where they are gripped by appropriate transfer means in the form of gripper fingers such as employed in U.S. Pat. No. 3,730,213 and 3,923,589 with the adhesive coated surfaces exposed. The rolling transfer of the labels from the picker to the surface of the transfer turret avoids lateral slipping and hence any scuffing or rubbing of the adhesive or wrinkling of the labels themselves.

Should it be desirable to employ a different number of picking elements or picking elements of different area or shape it is only necessary to remove the spider plate 79 and the nuts 78 at the lower ends of the extensions 70 and lift the shafts 58 to which the pickers are secured from the sleeves 60.

The mathematical ratios necessary to achieve the acceleration and deceleration can be readily computerized for the specific dimensions of the pickers, the glue roll, the length of the labels and the diameter of the transfer turret so that it is a simple procedure to cut a gear cam of suitable contours for accomplishing the desired acceleration and deceleration.

It should be understood that the present disclosure is for the purpose of illustration only and includes all modifications or improvements which fall within the scope of the appended claims.

I claim:

1. Apparatus comprising, a picker arranged to be driven in a circle about a predetermined fixed center relative to a plurality of stations surrounding the center comprising, instrumentalities for successively supplying glue to the picker, supplying labels to the picker and removing the glue coated labels from the picker and means for effecting rotation of the picker circularly relative to said stations and about its own axis comprising, a rotatable support mounting the picker for circular movement about said fixed center and for rotation about its own axis, means for rotating the rotatable support to effect movement of the picker from station-to-station, a sun gear fixed with respect to said fixed center, said sun gear having a variable radius of curvature, a planetary gear for rotating the picker about its own center, an idler gear in mesh with the planetary gear and sun gear and means pivotally supporting the idler gear for movement relative to the sun gear as the contour of the latter varies so as to maintain the idler gear in mesh with both the sun gear and the planetary gear throughout rotation of the planetary gear around the sun gear.

2. Apparatus according to claim 1, wherein the picker has a picking element provided with an arcuate surface of predetermined fixed radius of curvature and the instrumentalities at the several stations have different radii of curvature and wherein the variable radius of curvature of the sun gear is designed to provide for rolling tangential engagement of the arcuate surface of the picking element with each of the instrumentalities of different radius of curvature at the different stations.

3. Apparatus according to claim 2, wherein the picker has has three vertically spaced picking elements each of which has an arcuate surface, the means for supplying glue to the pickers is arranged to supply glue to each of said picker surfaces, there is means for supplying a label to each picker element of the picker and there is means for removing all three of the glue coated labels simultaneously.

4. Apparatus for applying glue to the surface of a label and placing the glue coated label on a transfer turret comprising, a picker having an arcuate surface of predetermined radius of curvature, means supporting the picker at a radial distance from a predetermined center of rotation for movement in a circle about said predetermined center and for rotation about its center of curvature while traveling in said circle about said predetermined center, a glue roll, a label holding device and a transfer turret arranged about said predetermined center at a distance such that the arcuate surface of the picker will at times have tangential engagement with the peripheral surface of the glue roll, the flat surface of the endmost label in the holding device and the peripheral surface of the transfer turret, a fixed gear at said predetermined center, said fixed gear having a varying radius of curvature, a picker gear movable with the picker about said fixed center for rotating the picker about its center of curvature, means for moving the picker and picker gear in a circle about said fixed gear, an idler gear in mesh with the picker gear movable around the fixed gear in consonance with the picker gear and means for maintaining the idler gear in mesh with both the fixed gear and the picker gear during such movement.

5. Apparatus according to claim 4 comprising, means supporting the idler gear for pivotal movement about a center spaced from said predetermined fixed center and a cam arranged by engagement with said last named means to maintain the idler gear in constant engagement with the fixed gear.

6. Drive mechanism for a picker designed to remove glue from a glue roll, apply it to the flat surface of a label and place the glue coated label on a transfer turret comprising, spaced parallel shafts, first means supporting one shaft for movement in a circle about the axis of the other shaft and means for effecting movement of said first means to effect movement of the one shaft circularly about the other, said one shaft mounting a picker for movement circularly about the other shaft relative to a glue applying roll, a label and a transfer roll arranged about said axis of the other shaft as a center characterized in that there is a sun gear of varying radius of curvature fixed to said other shaft, a planetary gear fixed to the one shaft, an idler gear arranged to mesh with the sun gear and planetary gear and means supporting the idler gear for movement relative to the sun gear while maintaining engagement with both the sun gear and the planetary gear.

7. Drive mechanism for a picker designed to remove glue from a glue roll, apply it to the flat surface of a label and place the glue-coated label on a transfer turret comprising a support shaft, a support mounted on the support shaft for rotation about the axis of the support shaft, means for rotating the support about the axis of the support shaft, a rotatable shaft mounted on the support with its axis parallel to that of the support shaft and at a predetermined radial distance therefrom for movement in a circle about the axis of the support shaft and for rotation about its own axis during rotation of the support, said rotatable shaft mounting a picker for movement circularly about the axis of the support shaft relative to a glue-applying roll, a label holder and a transfer roll arranged about the axis of the support shaft as a center, and means comprising a drive element fixed to the support shaft having a varying radius of curvature, a drivable element fixed to the rotatable shaft for effecting rotation of the rotatable shaft about its own axis, a transfer element arranged in engagement with the drive and drivable elements for transferring the rotation of one to the other and means supporting the transfer element for radial movement relative to the axis of the drive element while maintaining driving engagement with both the drive and drivable elements.

* * * * *